United States Patent [19]

Roth

[11] 4,079,311

[45] Mar. 14, 1978

[54] IGNITION TIMING MEASURING APPARATUS

[75] Inventor: Sydney J. Roth, New Berlin, Wis.

[73] Assignee: Applied Power Inc., Milwaukee, Wis.

[21] Appl. No.: 726,460

[22] Filed: Sep. 24, 1976

[51] Int. Cl.[2] ..... F02P 17/00

[52] U.S. Cl. ..... 324/16 T; 73/118

[58] Field of Search ..... 324/16 T; 73/118

[56] References Cited

U.S. PATENT DOCUMENTS

| | | | |
|---|---|---|---|
| 3,775,672 | 11/1973 | Letosky | 73/118 |
| 3,820,013 | 6/1974 | Gaudette, Jr. et al. | 324/16 T X |
| 3,863,498 | 2/1975 | Gunther | 324/16 T X |

*Primary Examiner*—Stanley T. Krawczewicz
*Attorney, Agent, or Firm*—Frederick E. Lange

[57] ABSTRACT

Apparatus for measuring the ignition timing of an internal combustion engine of the type having a pulse generator for indicating when the flywheel is in a predetermined position subsequent to top dead center and in which a pulse of predetermined amplitude is initiated by a signal from one spark plug and is terminated by a signal derived from the pulse generator. Correction is made for the reference angle between the top dead center position of the piston and the occurrence of the signal from the pulse generator by algebraically adding to the pulses a DC correction which is adjusted to conform with the known reference angle. The adjusted pulses are applied to a meter to indicate the amount of ignition advance or retard. A second meter indicates the amount of the correction voltage. The apparatus also has novel calibrating means for applying to the timing device two spaced voltage pulses spaced apart by the distance of a half cycle of a periodically varying commercial voltage of known frequency. A second periodically varying voltage is derived from the first periodically varying voltage by a frequency divider so that there is a definite frequency relationship between the two voltages. The width of a half cycle of the first voltage pulse thus has a predetermined angular relationship to the half cycle of the second voltage. The apparatus is calibrated by adjusting the apparatus so that the angular relationship displayed on the reference angle meter corresponds to the angular relationship between the two frequencies.

9 Claims, 4 Drawing Figures

FIG. 2
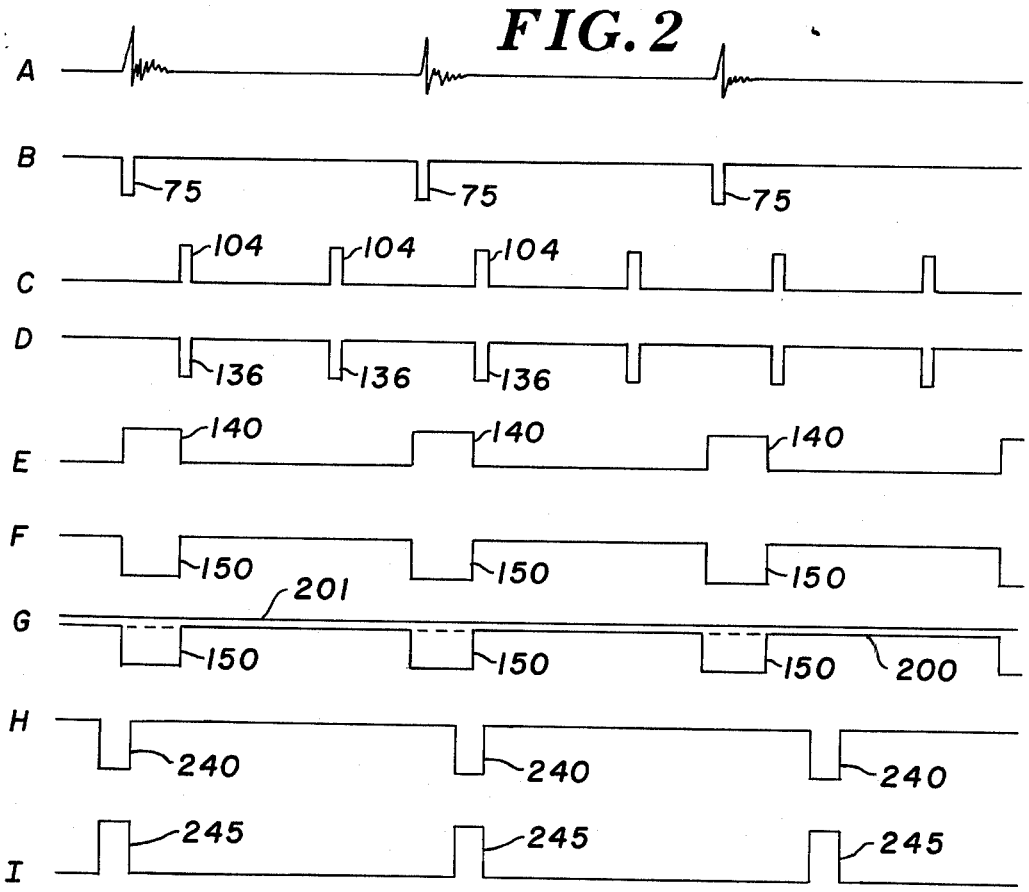
FIG. 4
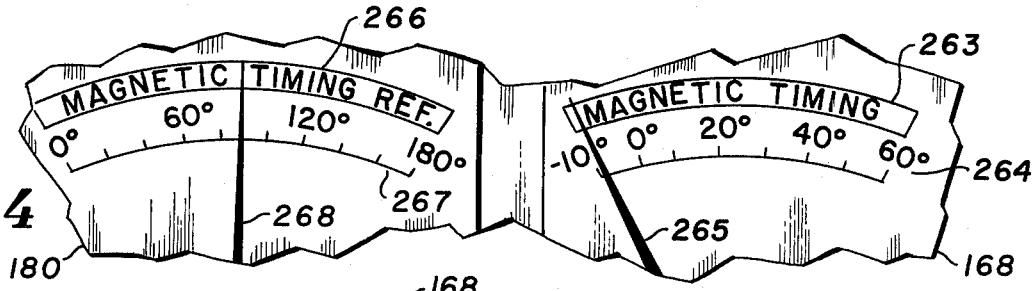
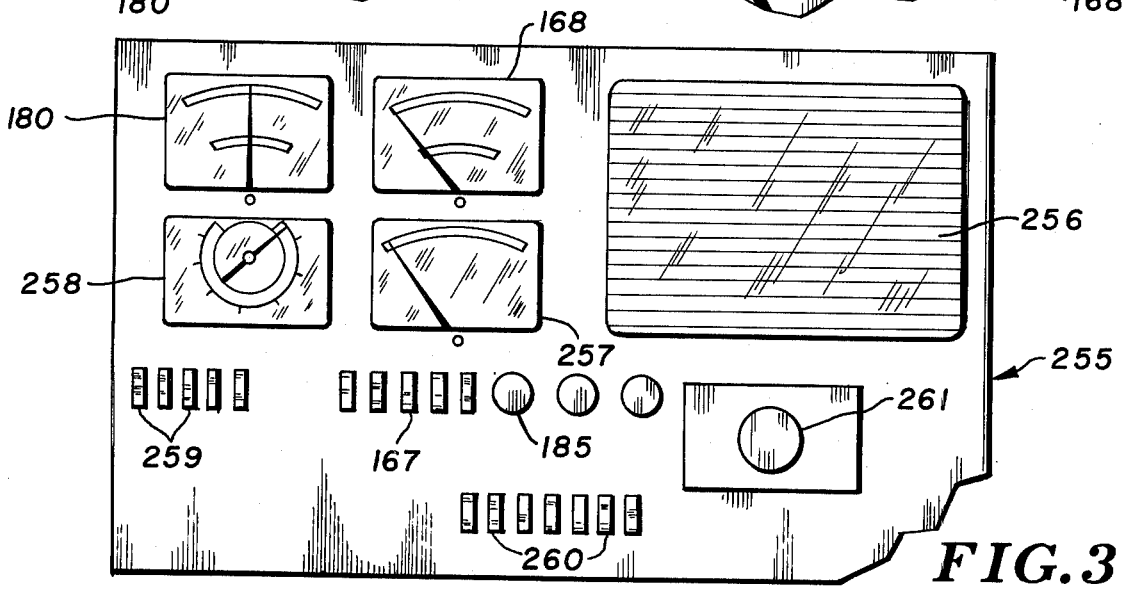
FIG. 3

IGNITION TIMING MEASURING APPARATUS

BACKGROUND OF THE INVENTION

For many years, it has been conventional practice in providing for the measurement and adjustment of the ignition angle of an internal combustion engine to provide a mark on the fly wheel of the engine which can be observed. A stroboscopic lamp is directed on the fly wheel and is energized by a signal from the ignition system which causes the stroboscopic lamp to be energized at a frequency corresponding to the speed of rotation of the engine. Thus, when such a stroboscopic lamp is employed to illuminate the fly wheel, the timing mark appears to be stationary. By employing a suitable delay device, it is possible to delay the energization of the stroboscopic light with respect to the firing of a particular plug so that the timing mark appears to be at the top dead center position of the fly wheel. The amount of adjustment required to cause the timing mark to appear at the top of the fly wheel is then employed to provide an indication of the ignition timing.

These previous arrangements have a number of disadvantages. In the first place, the timing mark is not readily visible due to the accumulation of dirt on the fly wheel and it is necessary to scrape the fly wheel to making the timing mark visible. In the second place, the operation described above basically requires a manual operation, namely the adjustment of the delay device until the timing mark appeared at the top. Furthermore, since different operators may have a different opinion as to when the timing mark is at the top, the measured timing angle can vary from operator to operator.

As a result of these difficulties, it has been increasingly common to provide the engine with some device for producing an electrical pulse when the crankshaft is in a predetermined position. By comparing the position of this pulse with the position of a pulse derived from the voltage applied to a particular plug, such as the "No. 1" plug of the engine, it is possible to determine the amount of angular displacement of the ignition. Unfortunately, the different manufacturers place magnetic pulse generators responsive to the position of the fly wheel at different points with respect to top dead center. This is partly due to the physical limitations in the placement of the magnetic pulse generator due to auxiliary equipment being employed. It is also due, in part, to the fact that different engineers have different opinions as to the most desirable location for such a magnetic pulse generator. As a result, if a timing measurement device is to be used with different types of automobile engines, some means must be provided for correcting for these differences in placement of the magnetic pulse generator, this displacement commonly being referred to as the reference angle.

It is also obviously necessary if apparatus is to be used with different engines for there to be some means for satisfactorily calibrating the reference angle correction means to insure that the correction introduced corresponds with the actual change in reference angle.

SUMMARY OF THE PRESENT INVENTION

The present invention is concerned with apparatus for measuring ignition timing in which a series of pulses are produced which are of constant amplitude but of a width dependent upon the ignition timing, these pulses being integrated and applied to an indicating device to indicate the ignition timing and in which there is means for algebraically adding to the pulses a correction voltage dependent upon the reference angle between the occurrence of a signal from a magnetic position sensor and the top dead center position of the piston.

The correction voltage may be a DC voltage and this voltage may be obtained from an adjustable voltage divider connected across a known source of DC voltage.

The adjustable voltage is not only algebraically added to the pulses but may also be applied to a meter which is calibrated in degrees of angular displacement of the reference angle.

The indicating device for indicating the amount of ignition advance may be a meter which is designed to indicate the angular displacement in degrees between the energization of the igniter and the top dead center position of the piston.

The apparatus may be designed for use with an engine in which the position pulse generating means is so located as to produce the pulse a predetermined angular distance after the top dead center position of the piston. This angular distance is preferably greater than any angle of retardation of the ignition timing so that the pulse derived therefrom is always subsequent to the pulse from the connection to the igniter. Thus, when the correction voltage for correcting for the reference angle is subtracted from the reference pulses, the resulting voltage will indicate the degree of ignition displacement regardless of whether the ignition is advanced or retarded.

It is further contemplated that there be calibrating means involving the use of two periodically varying voltages one of which is obtained from a source of power of known frequency and the other of which is derived from the first voltage through a frequency divider so that there is always a known frequency relation between the two voltages. By this means, it is possible to obtain a definite angular relation between the half cycles of the two periodically varying voltages and the apparatus can be calibrated to indicate this angular relationship. The voltage of known frequency can be derived from an ordinary commercial source of power.

The invention further contemplates a novel method of measuring ignition timing which involves deriving pulses of varying width depending upon the degree of ignition advance and algebraically adding to these pulses a voltage dependent upon the reference angle between the engine crankshaft position sensor and the top dead center position. The method further involves the application to the same timing apparatus as is employed for measuring the amount of ignition advance, two voltage pulses spaced apart by a distance determined by the frequency of one periodically varying voltage and at a frequency determined by that of a second periodically varying voltage having a lower frequency which has a predetermined frequency relationship to the first periodically varying voltage.

Various other objects of the invention will be apparent from the accompanying specification, claims, and drawing.

BRIEF DESCRIPTION OF THE DRAWING

FIG. 2 is a diagram showing the waveforms at various points in the circuit of FIG. 1, FIG. 3 is a view of a portion of the panel of the housing for housing the apparatus schematically shown in FIG. 1, and FIG. 4 is a portion of the panel of FIG. 3 shown on a larger scale.

DESCRIPTION OF THE PREFERRED EMBODIMENT

Figure 1:
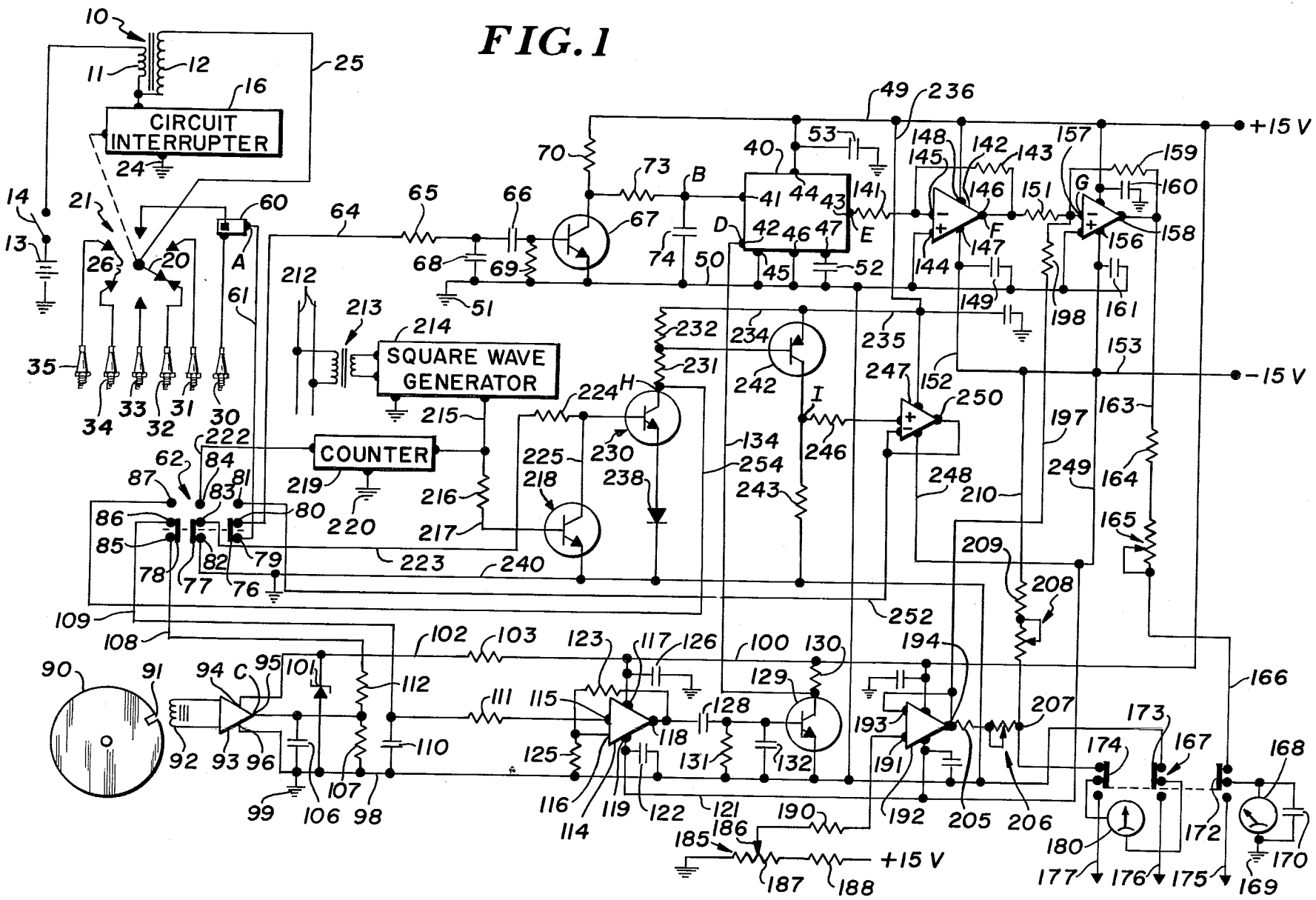
FIG. 1 is a schematic view of my improved apparatus shown in connection with the ignition system of a multicylinder internal combustion engine.

Referring first to FIG. 1, I have shown schematically the ignition timing apparatus of the present invention connected to an automobile ignition system. Referring to this automobile ignition system, which has been illustratively shown in connection with a six cylinder engine, numeral 10 indicates a usual ignition coil having a low voltage primary 11 and a high voltage secondary 12. The low voltage primary winding 11 is connected to the positive terminal of the automobile battery 13 through a switch 14 which can be the conventional "ignition" switch. Current flow from the positive terminal of battery 13 through primary winding 11 is controlled by a circuit interrupter 16, having a ground connection 24. The circuit interrupter is effective to interrupt periodically the current through the winding 11 in synchronism with the rotation of the crankshaft of the engine. Commonly, this may take the form of breaker points which are periodically opened and closed. In recent years, where electronic ignition is employed, this circuit interrupter may involve a magnetic rotor having a number of teeth corresponding to the number of cylinders of the engine and which generates a series of pulses. These in turn control an electronic switch controlling the connection of the primary winding 11 to ground. The present invention can be employed with any type of circuit interrupter.

The rotary element of the circuit breaker 16 driven by the engine is, in turn, connected through any suitable means to the distributor arm 20 of the distributor 21. The distributor arm 20 makes one complete revolution for each complete cycle of the engine which involves two complete rotations of the crankshaft of the engine. Each time that the circuit interrupter 16 is effective to interrupt current flow through the primary winding 11, an abrupt change occurs in the primary winding to cause a high voltage to be induced in the secondary winding 12. The upper terminal of secondary winding 12 is connected through a conductor 25 to the rotor 20. Rotor 20 is in turn adapted to make conductive connection with six distributor contacts 26, one for each cylinder of the engine. These distributor contacts are distributed uniformly around the distributor and are connected to six igniters 30–35 which are shown specifically as spark plugs. As the distributor rotor 20 moves into conductive relationship with any one contact 26, a firing voltage is applied to that one of the spark plugs 30–35 to which that particular contact is connected. The rotatable element of the circuit interrupter 16 and the distributor rotor are so connected that the high voltage pulses appearing in secondary winding 12 occur at approximately the times that the distributor rotor engages the contacts 26. Thus, as the distributor rotor rotates, being driven by the engine, a firing voltage is successively applied to plugs 30–35 in sequence. It is to be understood that each of these spark plugs 30—35 is associated with a different cylinder. While I have shown the spark plugs as located in a continuous row, it is to be understood that they are associated with the cylinders in such a manner as to produce a desired firing sequence. Furthermore, while I have specifically shown spark plugs, it is to be understood that other forms of igniters may be employed.

Turning now to the engine diagnostic apparatus, the reference numeral 40 is employed to indicate a timing device. This timing device can be any suitable type which, upon the reception of a first voltage pulse, will initiate a voltage output of a predetermined amplitude which continues until the reception of a second pulse. In this respect, the unit acts as a "flip-flop" pulse generator. In the specific aparatus shown, I have employed a 555 linear integrated circuit. This circuit is designed to function as a timing circuit. Referring to the conventional terminals of such a 555 integrated circuit, terminals 41, 42, 43, 44, 45, 46 and 47 are respectively the trigger, reset, output, power supply, ground, threshold and control voltage terminals, respectively. The power supply terminal 44 is connected to a conductor 49 leading to a suitable positive source of voltage such as a +15 V source. The ground terminal 45, along with the threshold terminal 46, is connected to a ground conductor 50 connected to ground at 51. The control voltage terminal likewise is connected to ground, being connected in this case through a capacitor 52 which in one particular embodiment was a 0.01 microfarad capacitor. Similarly, a capacitor 53 is connected between the power supply terminal 44 and ground to filter out any extraneous voltage signals from the power supply line 49.

The voltage applied to the trigger terminal 41, which initiates the voltage pulse, is obtained from the connection to a predetermined igniter such as igniter 30 which may constitute the "No. 1" plug. The reference numeral 60 is employed to indicate a clamp-on connector which surrounds the ignition lead extending from the plug 30 to the associated distributor terminal 26. Plug 30 is the "No. 1" plug in that it is the first in the firing sequence to have an igniting voltage applied thereto. The connector 60 is preferably an inductive connector which has a voltage induced in a coil thereof each time a firing voltage is applied to plug 60. This voltage is shown in waveform A of FIG. 2. It will be noted that there is an initial peak voltage followed by an oscillatory discharge. This voltage is transmitted through a conductor 61, a selector switch 62 (to be presently described), a conductor 64, a resistor 65 and a capacitor 66 to the base of an NPN transistor 67. A capacitor 68 is connected between right hand terminal of resistor 65 and ground and tends to bypass the high frequency components of the pulses picked up by the connector 60. The resistor 65 serves to attenuate the signal received by the pickup prior to its being applied to the base of transistor 67. The capacitor 66 serves to differentiate the signal and insure that only a high voltage peak is applied to the base of transistor 67. Connected between the base of transistor 67 and ground is a resistor 69 which normally, in the absence of a signal, maintains the base at ground potential to prevent flow of current between the collector and emitter of the transistor. Thus, depending upon the position of the switch 62, whenever a pulse is received by the connector 60, a sharp pulse is applied to the base of transistor 67 to cause it to become conductive. The collector of transistor 67 is connected through a resistor 70 to the power supply conductor 49 and the emitter is connected to ground conductor 50. The collector is also connected through a resistor 73 to the trigger terminal 41 of the timer 40. A capacitor 74 is connected between the right hand terminal of resistor 73 and ground to filter out any high frequency components that might be present in the signal appearing at the collector of transistor 67. The result of the circuit just traced is that whenever the connector 60 receives a pulse as the result of the energization of the "No. 1" plug 30, a negative going pulse is applied to the trigger terminal 41. These pulses are in waveform B of FIG. 2 and are identified by the reference numeral 75. The reason why the pulse is negative going is that the output of the transistor 67, upon a positive pulse being applied to the base, is negative due to the voltage drop across resistor 70 interposed between the collector and the positive side of the power line.

Turning now to the switch 62 which was briefly mentioned earlier, this switch is a switch with a plurality of movable switchblades connected to a common actuator and is provided for the purpose of switching between an operating and a calibrating condition. The switch assembly 62 comprises three movable switchblades 76, 77, and 78, all of which are mechanically interconnected and movable as a unit. The switchblade 76 is shown in engagement with switch contacts 79 and 80 and is movable into engagement with contacts 80 and 81. Similarly, switchblade 77 is shown in connection with contacts 82 and 83 and is mobable into engagement with switchblades 83 and 84. Switchblade 78 is likewise shown in engagement with contacts 85 and 86 and is movable into engagement with contacts 86 and 87. The switch contacts 76, 77 and 78 are shown in the "operating" position. When they are moved upwardly so as to be in engagement with contacts 81, 84 and 87, respectively they are in their "calibration" position. Thus, in the "operating" position shown, a circuit is established between conductor 61 leading from the connector 60 through contacts 79, switchblade 82 and contact 80 to the conductor 64 leading to the base of transistor 67.

Turning now to the input to the reset terminal 42 of timer 40, this is obtained from a signal dependent upon the position of the flywheel of the engine. The flywheel has been indicated schematically in the drawing by the reference numeral 90. It will be noted that this flywheel has a notch 91 therein. It will be appreciated that the size of this notch relative to that of the flywheel has been exaggerated for clarity of illustration. The flywheel is secured to the crankshaft and makes two revolutions for each revolution of the distributor arm 20. Located adjacent to the flywheel and in inductive relation therewith is an inductive coil 92. This inductive coil is connected to the input terminals of an amplifier 93 having a power supply terminal 94, an output terminal 95, and a ground terminal 96. The coil 92 and amplifier 93 are normally in a common housing of the pulse generating unit. The ground terminal 96 of amplifier 93 is connected to a ground conductor 98 which, in turn, is connected to ground at 99. The power supply conductor 94 is connected through a conductor 102 and a resistor 103 to a line 100 which is in turn connected to conductor 49 and hence to the +15 V power source. Connected between conductor 102 and ground is a Zener diode 101 which has a breakdown voltage of 4.7 V. Thus, a voltage of 4.7 V is maintained on the input terminal 94 of amplifier 93, the remaining portion of the 15 volts occurring as a voltage drag in resistor 103.

Each time that the notch 91 passes the inductive coil 92, a pulse is generated in the coil 92 which pulse is amplified to produce a positive pulse 104 shown in the waveform C in FIG. 2. It will be noted that there are two of these pulses 104 for each of the ignition pulses shown in waveform A. The reason for this is that the crankshaft makes two revolutions for each revolution of the distributor. It will also be noted that each of the pulses 104 is substantially displaced from the pulses 75 of waveform B formed as a result of the ignition pulses. Thus, the first of the pulses 104 occurs a substantial time after the first pulse 75. The angular displacement between the pulse 104 of waveform C and pulse 75 of waveform B is dependent upon two factors. In the first place, where the timing is advanced as is normally the case, the spark pulse resulting in the square wave pulse 75 occurs a substantial time before top dead center. In addition, the pickup 92 is so located that the pulse generated thereby occurs a substantial period of time after a piston of the No. 1 cylinder reaches top dead center. This displacement between the top dead center position and the angular position at which the pulse is produced by the coil 92 is called the reference angle. It varies with different cars depending upon the various factors determined to be desirable by the manufacturer. In some cases, the reference angle is only 10°. In other cases, it can be as much as 52½° or even 135°.

The voltage across output terminal 95 which, as previously pointed out, is in the form of a series of pulses 104 is applied across a capacitor 106 which acts as a filter capacitor to filter out any high frequency components of the signal. The resulting voltage is in turn applied across a relatively high resistor 107. The upper terminal of resistor 107 is connected through a relatively low value resistor 112, a conductor 108, contact 85 of switch 62 when the switch 62 is in the "operating" position, slider 78, contact 86, and conductor 109 to the upper terminal of a further capacitor 110. The voltage appearing across capacitor 110, which acts further to filter out any high frequency components in the signal, is applied through a resistor 111 to the noninverting input terminal 115 of an operational amplifier 114. The operational amplifier 114 is an integrated amplifier and preferably of the type commercially sold as a μA 741 operational amplifier. This amplifier has, in addition to the noninverting input terminal 115, an inverting input terminal 116, a positive power supply terminal 117, an output terminal 118, and a negative power supply terminal 119. The positive supply terminal 117 is connected to conductor 100 which, as previously explained, is connected to a +15 V power supply source. The negative power supply terminal 119 is connected to a conductor 121 which, in turn, is connected to a −15 V source of power. A capacitor 126 is connected between positive supply terminal 117 and ground and a capacitor 122 is connected between negative power supply terminal and ground. The capacitors 126 and 122 are provided to by-pass any undesired high frequency components. There is also a feedback connection from the output terminal 118 through a resistor 123 to the inverting input terminal 116. The inverting input terminal 116 is also connected through a resistor 125 to the ground conductor 98. The gain of amplifier 114 is dependent upon the relative values of resistors 123 and 125. In one typical case, resistor 123 had a resistance of 12 kilohms while resistor 125 had a resistance of only 1 kilohm. Thus, in this case, there was a gain of 12.

The output voltage appearing at terminal 118 which has been amplified by amplifier 114 is connected through a blocking capacitor 128 to the base of an NPN transistor 129. The collector of this transistor is connected through a resistor 130 to the +15 V conductor 100 and the base is also connected through a resistor 131 to ground so that in the absence of an input signal from the output of amplifier 114, the base is at ground potential. A filter condenser 132 is connected in parallel with resistor 131 so as to by-pass any high frequency components that might be present in the output of amplifier 114.

The result of a positive pulse being applied to the base of transistor 129 is to cause this transistor to become conductive, lowering the potential of the collector by reason of the increased voltage drop across resistor 130. The positive pulse applied to the base of transistor 129 is thus inverted creating a negative going pulse which is applied through conductor 134 to the reset terminal 42 of the timer 40. The waveform of the voltage applied to terminal 42 is indicated by the waveform D. It will be noted that this waveform D includes a number of negative pulses 136, each corresponding to one of the positive pulses 104, but merely inverted therefrom and, in most cases, of different amplitude.

Considering the operation of the timing apparatus 40, it will be recognized from the preceding description that a negative going pulse is applied to trigger terminal 41 each time that an ignition pulse is applied to spark plug 30. Similarly, a negative pulse is applied to the reset terminal each time that the coil 92 senses the presence of the notch 91. The pulses in question are indicated in FIG. 2 by the waveforms B and D. The timing apparatus functions so that each time that a negative pulse is applied to the trigger terminal 41, an output of a predetermined amplitude will appear at output terminal E. This output voltage will continue until a negative pulse is received at the reset terminal 42 at which time the voltage of the output terminal E will disappear. The result is a series of pulses of predetermined amplitude, the duration of these pulses being dependent upon the time between the application of negative pulses to the trigger terminal 41 and the reset terminal 42. The resulting pulses appear in waveform E of FIG. 2 and each pulse is designated by the reference numeral 140. It will be noted that each pulse 140 is initiated at the beginning of the negative pulse 75 of waveform B and is terminated at the beginning of the negative pulse 136 of waveform D. The total magnitude of the pulse 140 thus becomes a function of the time between the firing of the spark plug 30 and the generation of a pulse by the inductive coil 92. As will be pointed out later, the value of these pulses over a period of time is integrated to determine the timing of the engine.

The output voltage appearing at output terminal 43 of timer 40 is applied through a resistor 141 to the inverting input terminal 145 of an operational amplifier 142. The operational amplifier, like amplifier 114, can be of the type conventionally known as a μA741 amplifier and is provided with a noninverting input terminal 144, an output terminal 146, a negative power supply terminal 147 and a positive power supply terminal 148. The resistor 143 is connected between the output terminal 146 and the inverting input terminal 145 and acts with resistor 141 to control the gain of the amplifier. The gain of the amplifier is dependent upon the relative values of resistors 143 and 141. In one particular instance, a 15 kilohm resistor was employed for resistor 143 and a 10 kilohm resistor for resistor 141 giving the amplifier a gain of 1½. It will be noted that the positive power supply terminal 148 is connected to the +15 V conductor 49 and the negative power supply terminal 147 is connected through conductors 152 and 153 to the same −15 V source of power as is conductor 121, previously referred to in connection with amplifier 114. A capacitor 149 is connected between the negative power supply terminal 147 and ground to filter out any extraneous high frequency components. The amplifier 142 not only acts to amplify the voltage pulses from the timer 40, but also serves to invert them so that the output appearing at output terminal 146 is indicated by the waveform F of FIG. 2. it will be noted that the pulses 150 in waveform F are negative. They will have the same pulse width as pulses 140 of waveform E.

The pulses at the output terminal 146 are applied through a resistor 151 to the inverting input terminal 157 of a further amplifier 156 which is generally of the same character as amplifier 142. This amplifier has positive and negative power supply terminals which are respectively connected to conductors 49 and 153 leading to positive and negative voltage sources, respectively and have capacitors 160 and 161 connected between these power supply terminals and ground. It also has a noninverting input terminal connected to the ground conductor 50 as is the case in connection with amplifier 142. It also has an output terminal 158 and there is a feedback connection including a resistor 159 between output terminal 158 and the inverting input terminal 157. Again, the relative values of resistors 159 and 151 determine the gain of the amplifier. In this particular case, resistors of the same value were employed for resistors 159 and 151 so that the amplifier had a unity gain. The effect of the amplifier, however, is to again invert the signal so that the output of amplifier 156 is again a series of positive pulses which are applied through a conductor 163, a resistor 164, a rheostat 165, a conductor 166, and the contacts of a selector switch 167 to a meter 168 which has its opposite terminal connected to ground at 169. A capacitor 170 is connected across the meter 168 and acts to integrate the positive voltage pulses being supplied to the meter 168 to cause the meter to assume an average position depending upon the magnitude and relative width of the pulses as compared with the time of the engine cycle. The meter will take up an average position dependent upon the width of the pulses and hence dependent upon the time between the firing of the "No. 1" plug and the sensing of the notch 91 by the coil 92 as related to the time of the engine cycle. As will be explained later, this meter 168 will be calibrated to indicate the degrees of ignition timing. The rheostat 165 is designed to be adjusted to vary the sweep of the meter needle as will be described later.

Brief reference has been made to the selector switch 167. This switch is used in connection with meter 168 and meter 180, to be presently discussed. Meters 168 and 180 are both designed to be employed for several purposes and the function of switch 167 is to connect the meters 168 and 180 to the spark advance measuring mechanism when it is desired to measure spark advance and to disconnect these meters from the spark advance measuring apparatus when the meters are to be employed for other purposes. The switch 167 has three movable switchblades 172, 173 and 174 which are selectively movable from the upper position shown to a lower position. In the upper position shown, they bridge contacts which serve to connect the meters 168 and 180 to the ignition advance measuring apparatus. Thus, in the circuit traced through meter 168, the circuit went through the upper contacts in engagement with the movable switchblade 172. In the lower position of slidable contacts 172, 173 and 174, they connect meters 168 and 180 to conductors 175, 176 and 177 leading to signal sources connected with other types of tests.

The apparatus, as described, would be satisfactory to measure ignition advance if the pulse produced by coil 92 occurred at the top dead center position of the No. 1 cylinder. Unfortunately, as described previously, these pulses occur at different positions with respect to top dead center depending upon the particular manufacturer. In some cases, the pulse occurs as much as 135° after top dead center. If the ignition advance measuring apparatus is to be used with different vehicles and if it is desired to read the actual amount of ignition advance directly without computation, it is desirable to provide some means for compensating for the angular distance between top dead center and the occurrence of the pulse indicative of flywheel position. This angle is commonly called the "reference angle". In the present apparatus, this is done by algebraically adding to the pulses produced by the timer 40 a DC voltage having a value corresponding to the reference angle. Referring to the drawing, there is a potentiometer 185 having a slider 186 and a resistor 187. One terminal of resistor 187 is connected through a further resistor 188 to a +15 V power source whereas the opposite terminal of resistor 187 is connected to ground. Thus, the resistor 187 has a voltage applied thereacross which is dependent upon the relative values of resistors 187 and 188. In one particular case, an 18 kilohm resistor was employed for resistor 188 and a 5 kilohm resistor for resistor 187 of the potentiometer 185. In such case, the voltage across resistor 187 would be 5/23 of 15 V or 3.26 V. A selected portion of the voltage appearing across resistor 187 appears between the slider 186 and ground. The slider 186 is connected through a resistor 190 to the noninverting input terminal 191 of an amplifier 192 which is similar to amplifiers 142 and 156 in that it is an operational amplifier which may be of the type commercially sold as a μA741 amplifier. Operational amplifier 192, as with amplifiers 142 and 156, has, in addition to the noninverting input terminal 191, an inverting input terminal 193, output terminal 194 and positive and negative power supply terminals. The positive power supply terminal is connected to a +15 V power source. The negative power supply terminal is connected to conductor 121 which, as previously explained, is connected to a −15 V power source. The output terminal of amplifier 192 is connected directly to the inverting input terminal 193 of the amplifier. The primary function of the amplifier 192 is to isolate the voltage appearing at the output thereof from the potentiometer 185 to prevent any danger of feedback. The output of the amplifier 192 is connected through a conductor 197 and a resistor 198 to the inverting terminal 157 of amplifier 156. In other words, the voltage at the output of amplifier 192 is combined with the voltage from output terminal 146 of amplifier 142. As will be noted from FIG. 2, the output voltage of terminal 146, as shown in waveform F is a series of negative pulses. The voltage appearing at the output terminal of amplifier 192 is a continuous DC voltage which is positive with respect to ground. As a result, this added voltage is opposite in polarity to the polarity of the pulses 150. In waveform G, the effect of this is shown. Assuming that line 200 represents ground potential, then the voltage appearing between ground potential line 200 and line 201 represents the voltage which appears at the output of amplifier 192 and which is combined with the voltage pulses. It will be readily apparent that if these two voltages are added, the net effect is to reduce the integrated output of pulses 150 since the added voltage between ground line 200 and line 201 is not only opposite in potential but is continuous whereas the pulses 150 are intermittent in character. Thus, when one starts integrating the waveform G, the entire area between the ground line 200 and potential line 201 must be subtracted from the total of the pulses beneath the ground line 200. The result is that the integrated value of the current passing through meter 168 will be substantially reduced and the meter will have a lower reading than would otherwise be the case. The apparatus is designed so that the adjustment introduced by the addition of the voltage from amplifier 192 is sufficient to compensate for the reference angle so that the reading of meter 168 corresponds to the actual spark advance.

It is also important that one adjusting the slider 186 of the potentiometer 185 know how much adjustment is being effected. For this reason, I have also provided a meter 180, previously referred to, which, like meter 168, is located on the front panel as will be discussed later. The output of amplifier 192 is not only applied to the inverting input terminal of amplifier 156 but is also applied to the meter 180. When the slidable contacts 173 and 174 of selector switch 167 are in the upper position which they assume when magnetic timing is being measured, the lower terminal of meter 180 is connected through switch contact 173 to ground conductor 98. The upper terminal of the meter is connected through switchblade 174 to a junction point 207. This junction point is connected through a rheostat 206 and a resistor 205 to the output terminal of amplifier 192. The junction point 207 is also connected through a rheostat 208, a resistor 209 and a conductor 210 to conductor 153 which, as previously pointed out, goes to a −15 V power source. The junction 207 is thus maintained at a potential somewhere between the output potential of amplifier 192 and −15 V depending upon the values of resistors 205, 209 and the setting of rheostats 206 and 208. The connection to the −15 V source is necessary since the pointer of meter 180 is biased to a mid-position (because of other uses to which the meter is put in other tests) and it is necessary to apply a negative voltage to the meter to insure that the pointer will be at zero position when no signal is being received from amplifier 192. The resistor 209, in one particular embodiment, had a resistance of 17.4 kilohms while rheostat 208 had a maximum resistance of 5 kilohms. In the same embodiment, rheostat 206 had a maximum resistance of 3 kilohms while resistor 205 had a resistance of only 47 ohms. The voltage thus applied to meter 180 depends upon the settings of rheostats 206 and 208. Rheostat 208 is employed for adjusting the zero point of the meter. It will be obvious that as the value of this resistance is decreased, the potential of junction 207 will shift in a negative direction and it is possible, in this way, to adjust the meter so that when no signal is being applied by amplifier 192, the needle of meter 180 will be at the zero position despite being biased to a mid-position. The rheostat 206 is used to adjust the range of movement of the meter. It will be obvious that the smaller the impedance presented by the rheostat 206, the greater will be the effect of the voltage on the meter 180. Thus, by moving the slider to the right, the sweep of the needle is increased. The operation of these two units will be described later in connection with the calibration of the device. When properly calibrated, the meter 180 will indicate the amount of reference angle that has been inserted by adjustment of the slider 186 of rheostat 185.

This invention also involves a novel calibrating means. Broadly, this involves generating two signals spaced apart by an angular distance which has a known relation to the angular distance of a complete cycle. This is done by using a source of power of known frequency and then, through the use of a frequency divider, developing a second frequency having a known lower frequency value. If the distance between pulses of the lower frequency is assumed to be 360°, then the distance between pulses of the higher frequency current will be a predetermined fraction of the distance between the pulses of the lower frequency current. Spaced pulses corresponding to the higher frequency current can then be applied to the timing apparatus 40 to develop a series of waveforms which are integrated. By suitably adjusting the apparatus so that the reference angle indicated on meter 180 corresponds to the ratio between the two frequencies, it is possible to insure that the apparatus is properly calibrated. The apparatus and operation of the calibrating means will now be described.

A regular commercial source of power 212 represented by two line wires is connected to the primary winding of a transformer 213. The output of the secondary winding is connected to a square wave generator 214 of any suitable type, the output voltage of the primary being selected so as to supply a voltage of the proper magnitude to the input of the square wave generator. The square wave generator may be of any type which will, when an alternating current is applied thereto, have a square wave output. A typical unit of this type is one employing initial filtering circuits and a Schmitt trigger for converting the alternating sine wave into a square wave. The output of the square wave generator is applied through a conductor 215, a resistor 216 and a conductor 217 to the base of a transistor 218. The output of the square wave generator 214 is also applied to the input of a suitable frequency divider such as a counter 219 having a ground connection 220. In the particular example being considered, the source of power is a typical commercial source of power having a 60 Hz. frequency. The counter 219 generates a pulse output for each six pulses supplied to it; thus the output of counter 219 has a frequency of only 10 Hz. The output of the counter 219 is then applied through a conductor 222, contacts 84 and 83, and movable contact 77 of selector switch 62, conductor 223, resistor 224 and conductor 225 to the collector of an NPN transistor 218. In this way, a 10 cycle voltage is applied to the collector and a 60 cycle voltage to the base of transistor 218. Due to the resistor 224, the emitter becomes negative each time that the transistor 218 becomes conductive. This happens each time that the base is supplied with a positive potential from the 60 Hz. source during the positive going portions of the 10 Hz. voltage. This thus occurs six times during each cycle of the 10 Hz. voltage. If it be assumed that one cycle of the 10 Hz. frequency represents one distributor or two complete engine revolutions, which is equal to 720°, then each pulse occurring at the collector of transistor 218 represents 60°.

These 60° pulses appearing at the transistor 218 are applied to the base of a further NPN transistor 230. The collector of this transistor 230 is connected through two resistors 231 and 232 and conductors 234, 235 and 236 to the conductor 49 leading to the +15 V source of power. The emitter of transistor 230 is connected through a diode 238 to ground conductor 240. The pulses applied from the collector of transistor 218 to the base of NPN transistor 230 will cause a series of negative pulses to appear at the collector of transistor 230. These negative pulses are shown by the waveform H in FIG. 2 and are designated by the reference numeral 240. The junction of resistors 231 and 232 is in turn connected to the base of a PNP transistor 242 which has its collector connected through a resistor 243 to the ground conductor 240. Thus, each time that one of the negative pulses 240 is applied to the base of transistor 242, a positive pulse is produced at the collector. The positive pulses are indicated by the waveform I of FIG. 2 and are designated by the reference numeral 245. It will be noted that each of these pulses has a pulse width one-twelfth of that of the distance between two successive pulses. Thus, the pulses exist during one-twelfth of a cycle of the waveform I. These pulses are in turn applied through a resistor 246 to the noninverting input terminal of an operational amplifier 247. This amplifier is similar to amplifiers 142, 156, 114 and 247. The amplifier has a positive power supply terminal connected conductor 236 leading to the +15 V source and a negative power supply terminal connected through conductors 248 and 249 to the −15 V source. There is also a direct feedback connection between the output terminal 250 of amplifier 247 and the inverting input terminal of the amplifier. Due to this direct feedback, the amplifier has a gain of unity and is primarily provided for the purpose of isolating this output from that appearing at the collector of transistor 230. The leading edges of the pulses appearing at the output of amplifier 247 which correspond to the leading edge of pulses shown in waveform I are applied through conductor 252 to the switch contact 81 and, when the slide contact 76 is in the calibrating position, through the contact 80 and conductor 64 to the resistor 65 which, as previously explained, is connected to the base of transistor 67. In short, the leading edges of the pulses appearing at the output of operational amplifier 247 are applied to the base of transistor 67 instead of the pulses derived from the connection to the No. 1 spark plug lead. At the same time, the trailing edge of the pulses each appearing at the collector of transistor 230 are applied through conductor 254 to terminal 87 of the selector switch 62 and, when the selector switch is in its calibrating position, are applied through sliding contact 78, conductor 109, and resistor 111 to the noninverting input terminal 115 of the amplifier 114. In other words, the pulse obtained from the trailing edge of the pulse 240 is applied to the operation amplifier 114 in lieu of the pulse derived from the pickup 92. The effect of this is that a pulse is applied to the input terminal 41 of timer 40 at the time of occurrence of the leading edge of each pulse 245 and a pulse is also applied to the reset terminal 42 of timer 40 at the time of occurrence of the trailing edge of each pulse 240. It will be clear that the leading edge of each pulse 245 is spaced from the trailing edge of pulses 240 by an angular distance corresponding to the frequency of the 60 Hz. frequency. In other words, assuming 360° between the leading edges of pulses 245, the trailing edge of pulses 240 will be spaced from the leading edges of pulses 245 by an angular distance of 60°. The net effect will be that a series of pulses will be produced at the output terminal 43 of timer 41, each of which has a pulse width the equivalent of 60° as measured by the repetition rate of the pulses. These pulses are amplified by amplifier 156 and are applied to the timing advance indicator 168 in the same manner as the pulses derived in the normal manner were applied. It is now possible to calibrate the unit readily.

Before describing the calibration of the unit, the panel of FIG. 3 will be discussed. The numeral 255 is employed to indicate generally the front panel of a test apparatus having many functions besides that of measuring the timing angle. For example, there is a cathode ray tube, the screen of which appears in the drawing and is designated by reference numeral 256. There is also, in addition to the meters 168 and 180 previously discussed, a further pair of meters 257 and 258 which can be employed to indicate various functions. The meters 168 and 180 are not only designed to indicate various values in connection with the determination of the magnetic timing but also to perform other functions depending upon the position of the selector switch 167 previously discussed. As shown in FIG. 3, the selector switch is indicated by the push button 167. By actuation of this button, the switch is moved to the magnetic timing position shown in FIG. 1. There are also numerous other selector switches, each actuated by its own button. For example, the numerals 259 and 260 are employed to indicate banks of selector switches. Since the function of these switches play no part in the present invention, their function is not described. Similarly, there is a function selector knob 261 which can be rotated to select various tests to be performed, some of which are indicated on the screen 256 of the cathode ray tube.

In FIG. 4, significant portions of the meters 168 and 180 are reproduced on a somewhat larger scale. It will be noted that the meter 168 has a legend 263 reading "MAGNETIC TIMING". Below that is a scale 264 having calibrations beginning with −10° and extending up to 60°. The numeral 265 designates a pointer which is movable by a suitable meter movement over the scale 264.

Referring to the meter 180, this again has a legend 266 which reads "MAGNETIC TIMING REF" meaning that the meter indicates the magnetic timing reference angle. This likewise has a scale 267 which, in this case, is calibrated between zero and 180°. As has been pointed out, there are reference angles which are as large as 135° and the scale is designed to take care of reference angles up to 180°. Movable over the scale 267 is a pointer 268. As previously pointed out, the meter movement is biased so as to cause the pointer to assume a mid-position on the scale when the meter movement is deenergized. This is because the meter 180 has other scales and is used in connection with other tests.

CALIBRATION

Having described the meters and the calibration circuits, it is now possible to describe how the unit is calibrated. Initially, the calibration switch 62 is moved to the calibration position. This calibration switch does not normally appear on the front panel and is primarily intended to be accessible only at the factory or to the serviceman. The slider 186 of the potentiometer 185 is now moved to its extreme left position at which no voltage is being applied to the input of amplifier 192 and hence no voltage is being applied from potentiometer 185 to the input terminal 157 of the operational amplifier 156. In the arrangement shown in FIG. 3, the adjusting knob 185 is turned to its extreme counter-clockwise position. The rheostat 165 is now adjusted until the magnetic timing meter 168 indicates a reading of 50°. It was previously pointed out that the rheostat 165 is designed to adjust the sweep of the meter needle. The knob 185 (or slider 186 of potentiometer 185) is now adjusted so as to reduce the reading of meter 168 to −10°. This is the point of zero deflection of the meter. Potentiometer 206 is now adjusted so that the meter 180 reads 60°. It will be recalled that the length of the pulses 240 and 245 correspond to 60°. The meter should read 60° under these conditions since the application of the pulses 240 and 245 to the timer 40 causes a series of pulses which are of a duration equal to one-sixth of the total cycle. When this is done, the switch 62 can then be moved to the operating position and thereafter it will be assured that the meter 180 will correctly indicate the amount of reference angle which has been introduced and meter 168 will read the correct amount of timing adjusted for this reference angle.

VALUES OF COMPONENTS

In the foregoing description, reference has been made to the values of certain components in a typical piece of apparatus. In the table below, the values of the other components have been indicated. It is to be understood, of course, that the invention is in no way limited to the use of components of a particular value and that the values of the components given below are intended to be merely illustrative of those successfully used in one embodiment of the apparatus.

| Resistors | | Capacitors | |
|---|---|---|---|
| 65, 70, 107, 130, 131, 151, 243 and 246 | 10 kilohms | 53, 66, 68, 74, 110, 122, 126, 128, 149, 160 and 161 | .01 microfarad |
| 69 | 33 kilohms | 106 | .1 microfarad |
| 73 and 112 | 470 ohms | 132 | .047 microfarad |
| 103, 111, 190 and 164 | 1 kilohm | 170 | 2000 microfarad |
| 159 and 198 | 10 kilohms | | |
| 165 | Max. 2 kilohms | | |
| 216 | 100 kilohms | | |
| 224 | 2.2 kilohms | | |
| 231 and 232 | 4.7 kilohms | | |

OPERATION

While it is believed that the operation of the apparatus will be clear from the foregoing specification, the operation will be generally summarized in the following paragraphs.

When it is desired to measure the ignition timing of a vehicle equipped with a magnetic pulse indicator for indicating the position of the flywheel, the connector 60 is applied to the conductor leading from the distributor to the No. 1 spark plug 30. At the same time, connections are made to the coil 92. Customarily, the pickup including the coil 92 includes the amplifier 93 in a unit which has three terminals 94, 95 and 96. This unit is designed to have a three terminal connector connected therewith to make electrical contact with the three output terminals. The three conductors leading from terminals 94, 95 and 96 in FIG. 1 are thus automatically connected to the magnetic pulse generator.

It will also be assumed that the apparatus has been calibrated in the manner described under the heading "CALIBRATION" and that the switch 62 has been moved to the operating position shown in FIG. 1. Button 167, shown in the front panel of FIG. 3, will now be actuated to move the switch contacts 172, 173 and 174 to the position shown in FIG. 1. In this position, the meters 168 and 180 are connected to the portion of the apparatus for measuring the ignition timing.

The next step is to adjust the potentiometer 185 for the reference angle of the vehicle being tested. If this angle is not known, it must be determined from a suitable reference manual for the particular vehicle being tested. The knob of potentiometer 185 which controls the position of slider 186 is adjusted until the meter 180 indicates the reference angle in question. When this happens, meter 168 will indicate the amount of ignition advance or retardation. Summarizing, the signal from the No. 1 plug, shown in waveform A of FIG. 2, is filtered, amplified and inverted and applied to the input terminal 41 of timing apparatus 40, the pulses applied to timer 40 being indicated by the pulses 75 of waveform A of FIG. 2. At the same time, the pulses generated by the pickup 92 are filtered, amplified and inverted to produce the pulses 136 of waveform D of FIG. 2, these pulses being applied to the reset terminal 42 of timer 40. The result will be a series of pulses such as pulses 140 of waveform E of FIG. 2 which are of constant amplitude and which are of a duration dependent upon the amount of ignition advance and also on the amount of the reference angle. These voltage pulses are amplified and inverted in amplifier 142 and appear as voltage pulses 150 of waveform F of FIG. 2. The voltage employed to compensate for the reference angle and which is obtained from potentiometer 185, after passing through amplifier 192, is applied as a compensating voltage to the voltage pulses 150. This voltage is a continuous positive voltage and, as shown in waveform G of FIG. 2, tends to oppose the voltage of pulses 150 and reduce the integrated value thereof. The resultant voltage is then applied to meter 168 where it tends to be integrated or averaged out by capacitor 170 to produce a reading of meter 168 corresponding to the average integrated value of pulses 150 reduced by the integrated value of the voltage represented by line 201 of waveform G. The resultant reading of meter 168 will be a reading of the magnetic timing irrespective of the amount of the reference angle.

CONCLUSION

It will be seen that I have provided apparatus which enables ready adjustment for the amount of the reference angle. It will also be seen that I have provided a simple means of calibrating the ignition timing measurement apparatus. It will also be seen that I have provided a timing measurement apparatus which is extremely simple to use and which can be readily attached to a vehicle being tested with a minimum of effort. It will also be seen that I have provided a novel method of measuring ignition timing.

While I have shown a specific embodiment of my invention for purposes of illustration, it is to be understood that the scope of the invention is limited solely by that of the appended claims.

I claim:

1. Apparatus for measuring the ignition timing of an internal combustion engine having a rotating crankshaft, a piston driven thereby, electrical signal generating means located adjacent a rotating member driven by said crankshaft to indicate when said crankshaft is in a predetermined position, an igniter, and means for periodically energizing said igniter, said apparatus comprising:

means adapted to be connected to said igniter to produce a first electrical signal when said igniter is energized, means adapted to be connected to said electrical signal generating means to produce a second electrical signal when said crankshaft is in a predetermined position subsequent to the top dead center position of the piston by an angular displacement which is constant for any one engine but which varies with engines of different manufacturers, a timing device effective upon the application of an input signal to a first input terminal thereof to initiate a pulse of predetermined amplitude at the output terminal of said timing device and upon the application of an input signal to a second input terminal thereof to terminate said pulse, means for applying said first electrical signal to said first input terminal of said timing device and said second electrical signal to said second input terminal of said timing device to produce at the output terminal thereof a plurality of pulses each of a width corresponding to the time existing between said first and second electrical signals, an indicating device, means for applying to said indicating device a signal dependent upon the integrated output of said pulses to cause said indicating device to indicate the timed relationship between energization of said igniter and the top dead center position of said piston, and a correction means for algebraically adding to said pulses a voltage dependent upon the reference angle between the occurrence of said second electrical signal and the said top dead center position of the piston.

2. The apparatus of claim 1 in which the correction voltage is a DC voltage.

3. The apparatus of claim 1 in which said correction voltage is also applied to a meter which is calibrated in degrees of angular displacement between the occurrence of the second electrical signal and the top dead center position of the piston.

4. The apparatus of claim 1 in which said indicating device is a meter which is designed to indicate the angular displacement in degrees between the energization of the igniter and the top dead center position of said piston.

5. The apparatus of claim 1 in which there is calibrating means including for applying to said timing device two spaced voltage pulses obtained from a periodically varying voltage of known frequency and applying said spaced voltage pulses to said timing device at a frequency determind by the frequency of a second voltage derived from said first voltage through a frequency divider so as to have a frequency which is a fraction of the frequency of said first voltage.

6. The apparatus of claim 1 in which the first voltage is a commercial source of power of known frequency.

7. The apparatus of claim 1 in which the apparatus is designed for use with a multi-cylinder engine with an igniter for each cylinder and in which the means adapted to be connected to an igniter is adapted for connection to one of said igniters.

8. The apparatus of claim 1 in which the voltage added to said pulses is a DC voltage and in which said voltage is obtained from an adjustable voltage divider connected across a known source of DC voltage.

9. The method of measuring the ignition timing of an internal combustion engine having a rotating crankshaft, a piston driven thereby, electrical signal generating means located adjacent a rotating member driven by said crankshaft to indicate when said crankshaft is in a predetermined position, an igniter, and means for periodically energizing said igniter, said method comprising:

obtaining from a connection to said igniter a first electrical signal when said igniter is energized, obtaining from a connection to said electrical signal generating means a second electrical signal when said crankshaft is in a predetermined position subsequent to the top dead center position of the piston by an angular displacement which is constant for any one engine but which varies with engines of different manufacturers, producing from said first and second electrical signals a plurality of pulses each initiated upon the occurrence of said first signal and terminated upon the occurrence of said second signal so as to be of a width corresponding to the time existing between said first and second electrical signals, and applying to an indicating device a signal dependent upon the integrated output of said pulses to cause said indicating device to indicate the timed relationship between energization of said igniter and the top dead center position of said piston, and algebraically adding to said pulses a voltage dependent upon the reference angle between the occurrence of said second electrical signal and the said top dead center position of the piston to adjust for the reference angle of the engine being tested.

* * * * *